US007976020B2

(12) United States Patent
Awai

(10) Patent No.: US 7,976,020 B2
(45) Date of Patent: Jul. 12, 2011

(54) RECORDING APPARATUS

(75) Inventor: Takashi Awai, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 238 days.

(21) Appl. No.: 12/467,509

(22) Filed: May 18, 2009

(65) Prior Publication Data

US 2009/0295082 A1 Dec. 3, 2009

(30) Foreign Application Priority Data

May 29, 2008 (JP) ..... 2008-140599

(51) Int. Cl.
*B65H 31/04* (2006.01)

(52) U.S. Cl. ..... 271/213

(58) Field of Classification Search ..... 271/213; 399/405; 347/104
See application file for complete search history.

(56) References Cited

U.S. PATENT DOCUMENTS 7,281,791 B2 * 10/2007 Anami et al. ..... 347/104
7,290,763 B2 11/2007 Suzuki et al. ..... 271/9.13
7,398,971 B2 * 7/2008 Horiba ..... 271/162
7,614,739 B2 * 11/2009 Anami et al. ..... 347/104
7,905,482 B2 * 3/2011 Matsumoto ..... 271/213

FOREIGN PATENT DOCUMENTS

JP 2007-161369 6/2007

* cited by examiner

*Primary Examiner* — David H Bollinger
(74) *Attorney, Agent, or Firm* — Fitzpatrick, Cella, Harper & Scinto

(57) ABSTRACT

There is provided a recording apparatus capable of bringing a delivery tray to an open state automatically when a sheet material is conveyed without the need for a solenoid to open the delivery tray, and preventing the delivery tray from opening inadvertently except during recording. The recording apparatus includes a delay mechanism having plural ring members rotatable with some delay in sync with a delivery roller, and a control mechanism having plural link members, and plural elastic members. Plural cam portions rotatable together with the plural ring members, and a phase control unit for controlling the phases of the plural cam portions are provided in the delay mechanism. One link member of the control mechanism is connected to a delivery tray. When the phases of the plural cam portions match, the delivery tray is opened through the control mechanism by a drive of the delivery roller.

19 Claims, 13 Drawing Sheets

RECORDING APPARATUS

BACKGROUND OF THE INVENTION

1. Field of the Invention

The present invention relates to a recording apparatus including a delivery roller for ejecting a sheet material and a delivery tray openably/closably attached to the apparatus main body to hold the sheet material ejected by the delivery roller.

2. Description of the Related Art

The delivery tray of the recording apparatus is openable/closable about a pivotal shaft. When the recording apparatus is not in use, the delivery tray can be held in a closed state to make the apparatus compact and prevent dust from entering a recording section. However, if recording is started with the delivery tray closed, ejection of a recorded sheet material is blocked by the delivery tray, and this may cause inconvenience such as paper jam inside the apparatus.

FIG. 13 is a perspective view of an automatic opening mechanism for a conventional delivery tray. In this recording apparatus, a delivery tray 144 is automatically opened at power-on or in accordance with a recording instruction. The delivery tray 144 rotates and opens in the direction of arrow C about a rotating shaft 145 with respect to the apparatus main body. In FIG. 13, the inside of the apparatus is on the front side of the drawing, the outside of the apparatus is on the back side, and a chain double-dashed line represents a state in which the delivery tray 144 is open. In the open position, the delivery tray 144 is held in contact with a receiving portion of the apparatus main body.

The center of gravity of the delivery tray 144 is located further outside the apparatus than the rotating shaft 145. A tray lock 100 for holding the delivery tray 144 in the closed state is provided in the apparatus main body. An engaging portion 101 of the tray lock 100 is caught in a depressed portion 149 of the delivery tray 144 to lock the delivery tray 144 in the closed position. The tray lock 100 can be pivoted on a pivotal shaft 103 in the direction of arrow B to release the lock. The tray lock 100 is urged by a spring 110 in a direction opposite to the direction of arrow B. The delivery tray 144 receives a lateral pressure from the engaging portion 101 urged by the spring 110, and this prevents the delivery tray 144 from opening under self-weight in the direction of arrow C.

A plunger 121 of a solenoid 120 is connected to an end portion 102 of the tray lock 100. When the plunger 121 is actuated in the direction of arrow A at power-on or in accordance with a recording instruction, the end portion 102 of the tray lock 100 is pulled in the direction of arrow A. This causes the engaging portion 101 of the tray lock 100 is separated from the depressed portion 149, so that the delivery tray 144 rotates in a direction to open under self-weight and is held in an open position (use position) indicated by the chain double-dashed line.

When closing the delivery tray 144 from the open state, an operator rotates the delivery tray 144 in a direction opposite to the direction of arrow C. As a result, the engaging portion 101 of the tray lock 100 is engaged in the depressed portion 149 of the delivery tray 144 by the urging force of the spring 110, thereby holding the delivery tray 144 in the closed state. Further, when a tray button 130 is pressed in the direction of arrow D in such a state that the delivery tray 144 is closed, a cam portion 131 of the tray button 130 comes into contact with a projecting portion 105 of the tray lock 100 to rotate the tray lock 100 in the direction of arrow B against the urging force of the spring 110. In other words, the delivery tray 144 can also be opened by pressing the tray button 130.

Japanese Patent Application Laid-Open No. 2007-161369 discloses a recording apparatus provided with a solenoid on the body side and a permanent magnet in a foldable tray. When closed, the tray is kept in the closed state by the attraction of the magnet, while when being automatically opened, the tray is opened by the magnetic repulsion of an electromagnet.

However, the above-mentioned conventional technique has the disadvantage of high cost because of use of the solenoid 120 to rotate the tray lock 100.

SUMMARY OF THE INVENTION

The present invention has been made in view of such a technical problem, and it is an object thereof to provide a recording apparatus capable of bringing a delivery tray to an open state automatically when a sheet material is conveyed without the need for a solenoid to open the delivery tray, and preventing the delivery tray from opening inadvertently except during recording.

The present invention provides a recording apparatus including a delivery roller for ejecting a sheet material, a delivery tray openably/closably attached to an apparatus main body to hold the sheet material ejected by the delivery roller, a delay mechanism comprising plural ring members rotatable with some delay in sync with the delivery roller, and a control mechanism comprising plural link members and plural elastic members, wherein plural cam portions rotatable together with the plural ring members and a phase control unit for controlling the phases of the plural cam portions are provided, one link member of the control mechanism is connected to the delivery tray, and the delivery tray is opened through the control mechanism by a drive of the delivery roller when the phases of the plural cam portions match.

According to the present invention, there is provided the recording apparatus capable of bringing the delivery tray to the open state automatically when the sheet material is conveyed without the need for a solenoid to open the delivery tray.

Further features of the present invention will become apparent from the following description of an exemplary embodiment with reference to the attached drawings.

DESCRIPTION OF THE EMBODIMENT

Figure 1:
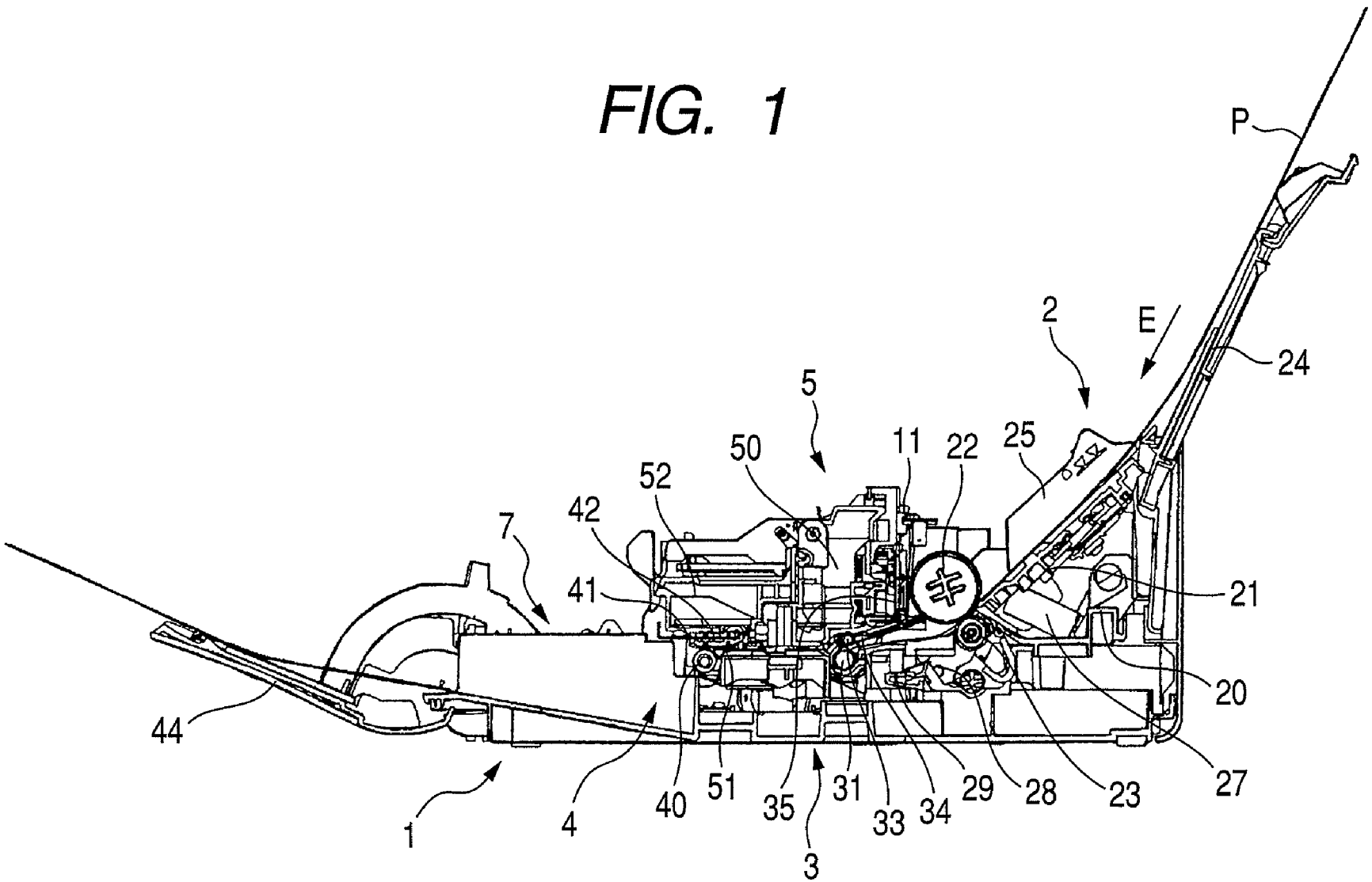
FIG. 1 is a longitudinal sectional view of a recording apparatus according to an exemplary embodiment.
Figure 2:
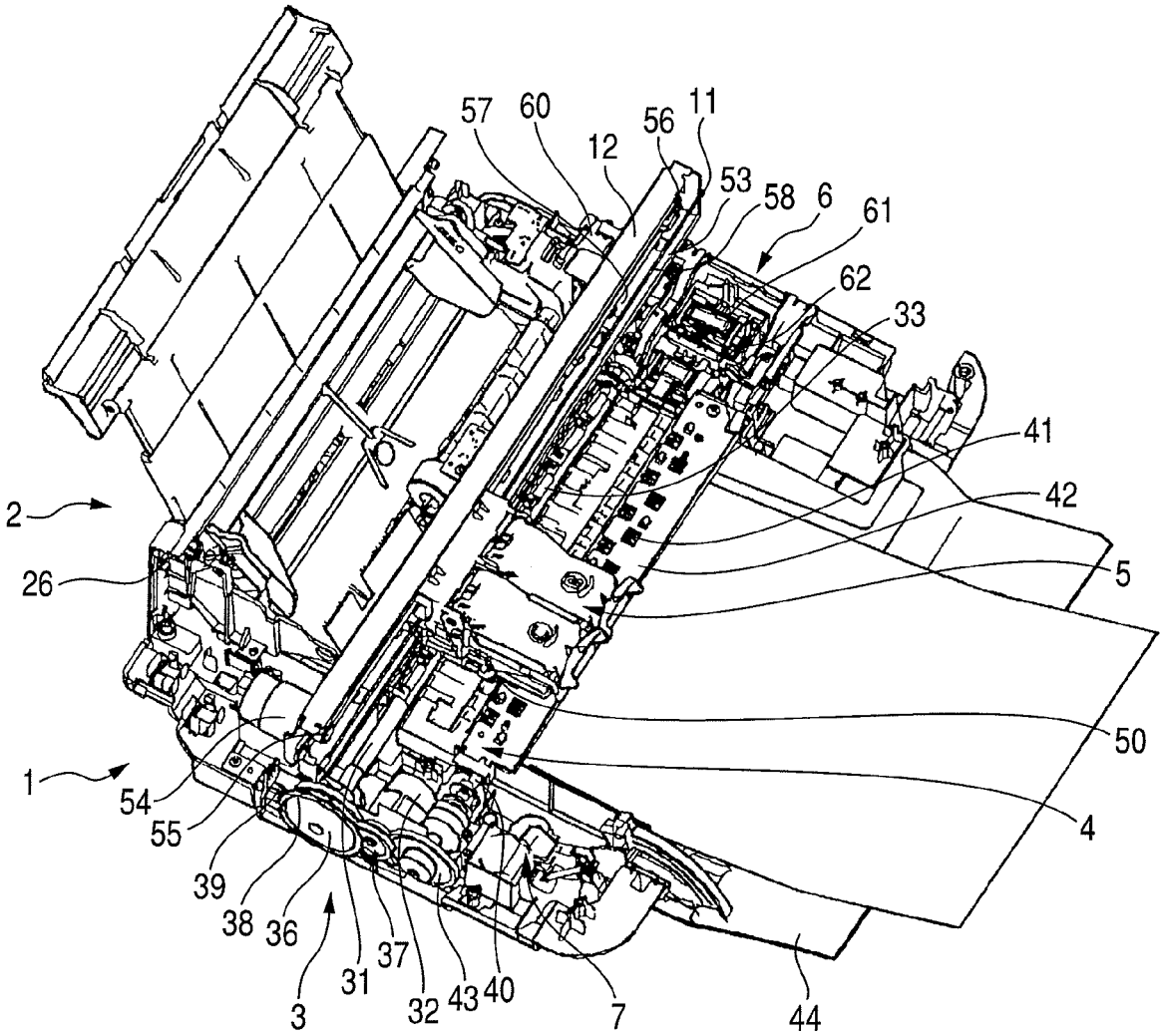
FIG. 2 is a perspective view of the recording apparatus according to the exemplary embodiment as seen from above the left front.

An exemplary embodiment of the present invention will now be described. Note that the same reference numerals indicate the same or corresponding portions throughout the drawings. FIG. 1 is a longitudinal sectional view of a recording apparatus with a sheet ejection device according to the embodiment. FIG. 2 is a perspective view of the recording apparatus according to the embodiment as seen from above the front left thereof. In FIG. 1, the front side of the apparatus is on the left side of the drawing and the rear of the apparatus is on the right side of the drawing. A recording apparatus 1 includes a feeder section 2, a conveyance section 3, a delivery section 4, a recording section 5, and a recovery section 6. The recording apparatus 1 also includes a delivery tray opening/closing control section 7.

The feeder section 2 is so constructed that a pressure plate 21 for loading sheet materials P as recording media, a feed roller 22 for feeding the sheet materials P, a sheet material separation roller 23 for separating the sheet materials sheet by sheet, and the like are mounted in a base 20. A feeder tray 24 for partially supporting the sheet materials P loaded on the pressure plate 21 is attached to an outer case located in a rearward position of the apparatus. Arrow E indicates a direction to feed the sheet materials. A side guide 25 for regulating the loading position of the sheet materials P in the width direction is attached to the pressure plate 21. The feed roller 22 is driven by a conveyance motor 32 together with a conveyance roller 31 and a delivery roller 40, both of which will be described later. The conveyance motor 32 is also used for driving a suction pump 60 in the recovery section 6 to be described later.

The pressure plate 21 is swingable about a shaft center 26 provided in the base 20, and is urged by a spring 27 toward the feed roller 22. The pressure plate 21 comes into contact with and is separated from the feed roller 22 by means of a pressure plate cam, not illustrated. A separation roller holder 28 pivotally supporting the separation roller 23 is attached to the base 20. The separation roller holder 28 is rotatable about a rotating shaft provided in the base 20, and is urged by a spring 29 toward the feed roller 22. The separation roller 23 is pivotally supported through a torque limiter. The separation roller 23 rotates when a certain amount of load torque or more is exerted. The rotational position of the separation roller holder 28 can also be controlled to bring the separation roller 23 into contact with or into separation from the feed roller 22. The positions of the pressure plate 21, the separation roller 23, and the like are detected by an ASF sensor, not illustrated.

In the conveyance section 3, a PE (paper end) sensor, not illustrated, is provided to detect a sheet material P and the conveyance roller 31 for conveying the sheet material. The conveyance roller 31 is located on the upstream side of a recording head 51. The conveyance roller 31 is a roller formed with ceramic fine particles coated on the surface of a metal shaft, and is pivotally supported by a bearing provided in a chassis 11. A conveyance force is generated by pressing plural pinch rollers 33 on the conveyance roller 31 so as to be driven to rotate. Each of the pinch rollers 33 is held in a swingable holder 34 and urged by a spring 35 toward the conveyance roller 31. A conveyance roller gear 36 for transmitting a driving force is fixed to a shaft end of the conveyance roller 31.

The conveyance roller 31 is driven by transmitting the torque of the conveyance motor 32 to the conveyance roller gear 36 through a pinion gear 37 and an idler gear. A code wheel 38 is provided around the conveyance roller gear 36. Markings of the code wheel 38 are read by an encoder sensor 39 to detect a conveyance capacity of the conveyance motor 31. The sheet material P can be conveyed by the conveyance roller 31 with precision through the recording section 5 in which an image is recorded on the sheet material P.

The recording section 5 is on the downstream side of the conveyance roller 31 in a direction to convey the sheet material. The recording head 51 is mounted on a carriage 50 capable of reciprocating across the conveyance direction. The embodiment illustrates such a case that the recording apparatus is an inkjet recording apparatus and the recording head 51 is an inkjet recording head in which multiple ink discharge ports are formed in a discharge area that faces the sheet material P. In this inkjet recording apparatus, ink is selectively discharged from each discharge port of the recording head 51 onto the sheet material P based on image information in sync with the movement of the carriage 50 to record a certain image. The recording head 51 is constructed in the form of a cartridge in which the recording head 51 is integrated with an ink tank 52. Plural cartridges can be used to record a color image.

The carriage 50 can reciprocate along a guide rail 12 and a chassis rail 53, both of which are provided in the chassis 11. The carriage 50 is driven by a carriage motor 54 through a timing belt 57 suspended in a tensioned state between a motor pulley 55 and an idler pulley 56. A code strip 58 is suspended in a tensioned state in parallel with the chassis rail 53. Markings are formed on the code strip 58, for example, at a pitch of 150 to 300 lpi, and are read by an encoder sensor mounted in the carriage 50 to detect the position and speed of the carriage 50. A flexible substrate for transmitting an actuating signal and a data signal to the recording head 51 is connected to the carriage 50. In such a structure, image recording for one line by the recording head 51 and conveyance of the sheet material by a certain pitch are alternately repeated to record an image on the sheet material P.

In the delivery section 4, a delivery roller (paper ejection roller) 40 for ejecting the sheet material P is provided. A delivery roller gear 43 for transmitting a driving force is fixed to a shaft end of the delivery roller 40. The driving of the delivery roller gear 43 is linked with the conveyance roller gear 36 through the idler gear. The delivery roller 40 is driven by the conveyance motor 32 in sync with the conveyance roller 31. Plural spurs 41 as rotating bodies for providing a conveyance force are pressed on the delivery roller 40 in such a manner that the spurs 41 can be driven to rotate.

Figure 5:
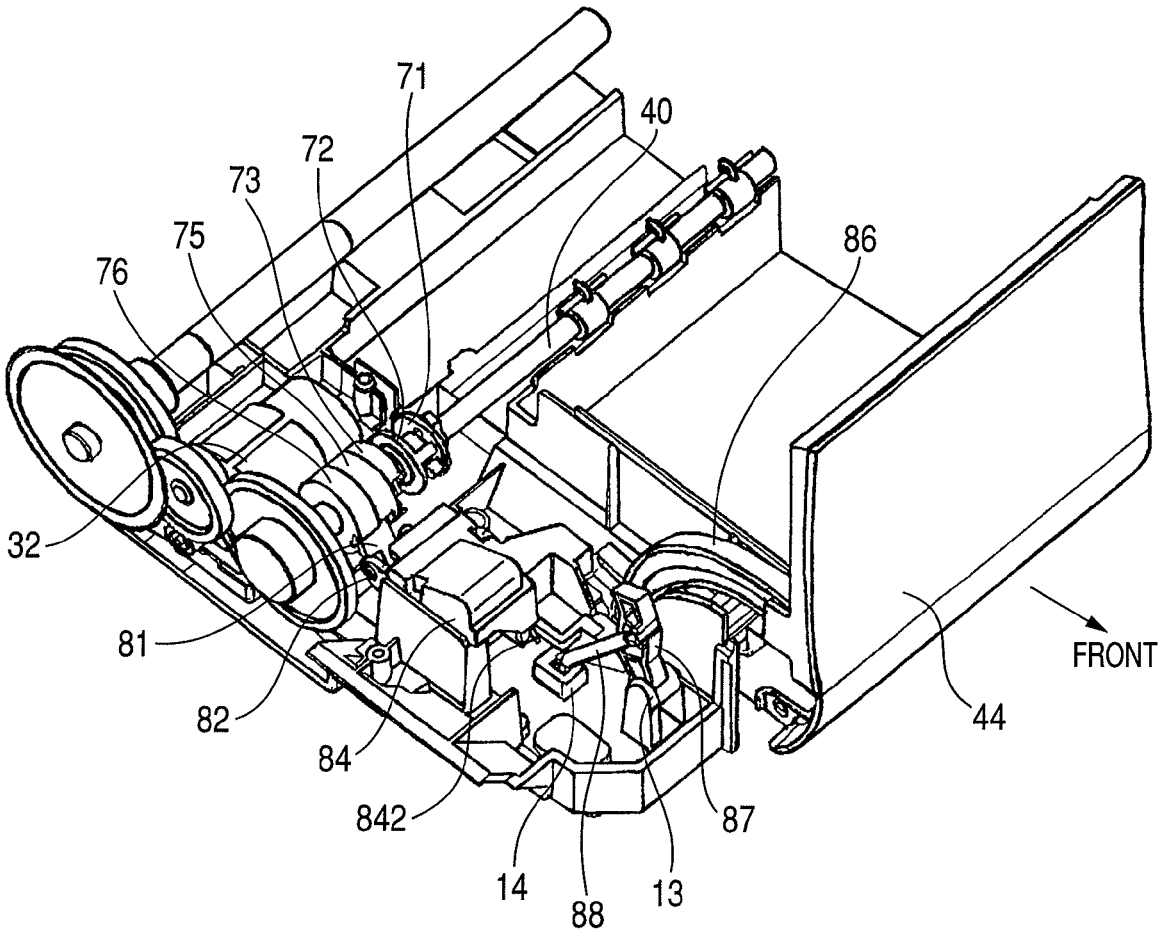
FIG. 5 is a perspective view of the delivery tray opening/closing control section as seen from above the left front.

A delivery tray 44 for holding the sheet material P ejected by the delivery roller 40 is attached to the front of the recording apparatus in a foldable manner. The delivery tray 44 can rotate about a rotating shaft 45 between an open position and a closed position. FIG. 1 and FIG. 2 illustrate a state in which the delivery tray is open, and FIG. 5 illustrates a state in which the delivery tray is closed. The sheet material P after subjected to recording by the recording head 51 is conveyed through nips between the delivery roller 40 and the spurs 41 by a drive of the conveyance motor 32 in the normal direction (a drive of the conveyance roller 31 in the normal direction of rotation), and ejected onto the delivery tray 44 in the open state. The ejected sheet material P is placed and held on the delivery tray 44.

This inkjet recording apparatus is provided with the recovery section 6 for preventing clogging of the discharge ports of the recording head 51 and performing maintenance and recovery of ink discharge performance. The recovery section 6 includes a suction pump 60, a cap 61, and a wiper 62. The cap 61 is brought into close contact with the discharge area of the recording head 51 to cover the discharge ports in order to protect the discharge area and reduce ink drying. The suction pump 60 is connected to the cap 61 to suck ink forcibly from the discharge ports. A tube pump of the type that a tube is squeezed by a roller to generate a negative pressure is used as the suction pump 60. The tube pump is driven by the conveyance motor 32. The wiper 62 wipes off ink and dust adhering to the discharge area of the recording head.

Figure 3:
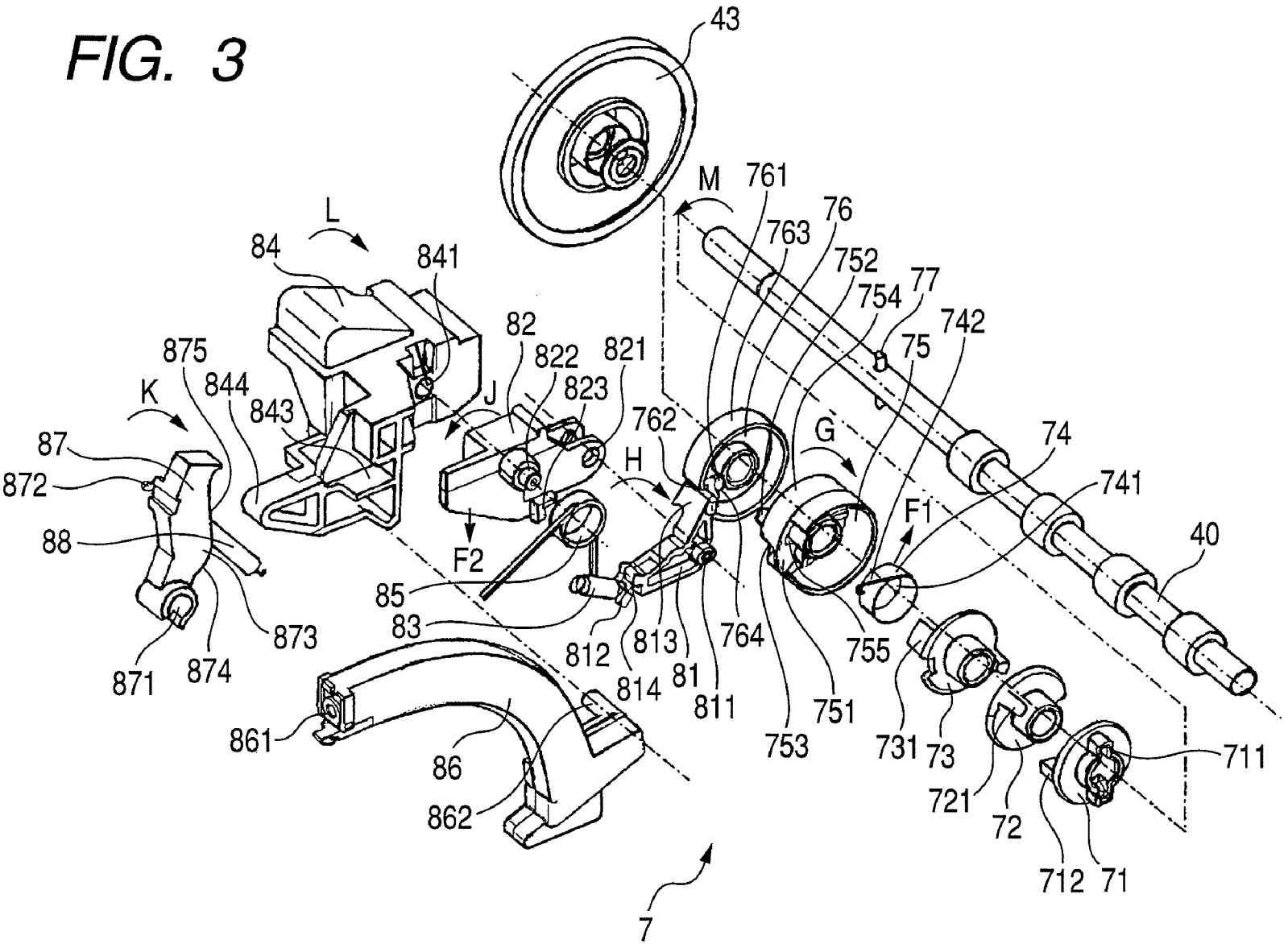
FIG. 3 is an exploded perspective view of a delivery tray opening/closing control section as seen from above the right front.
Figure 6:
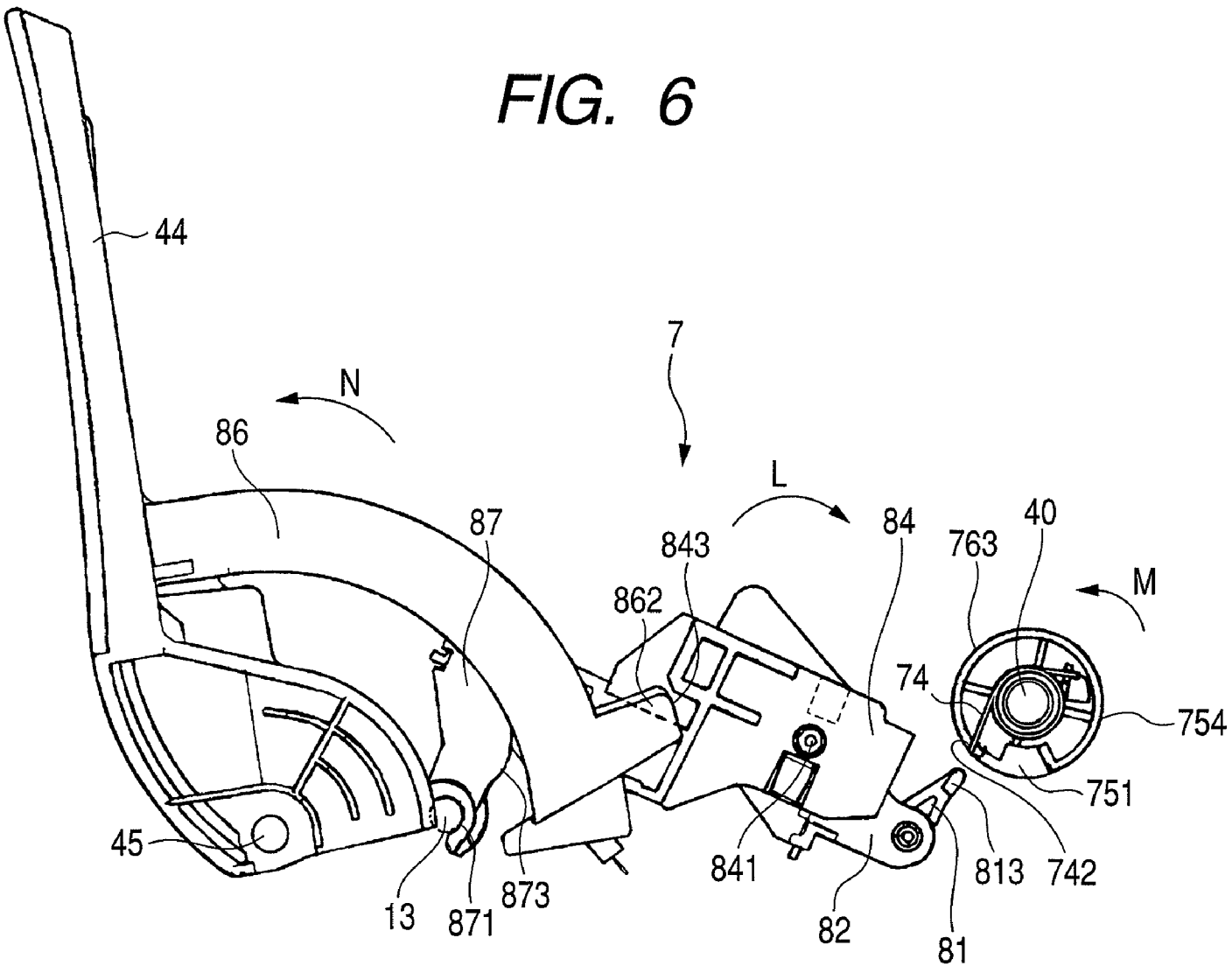
FIG. 6 is a side view of the delivery tray opening/closing control section in the process of opening or closing.
Figure 7:
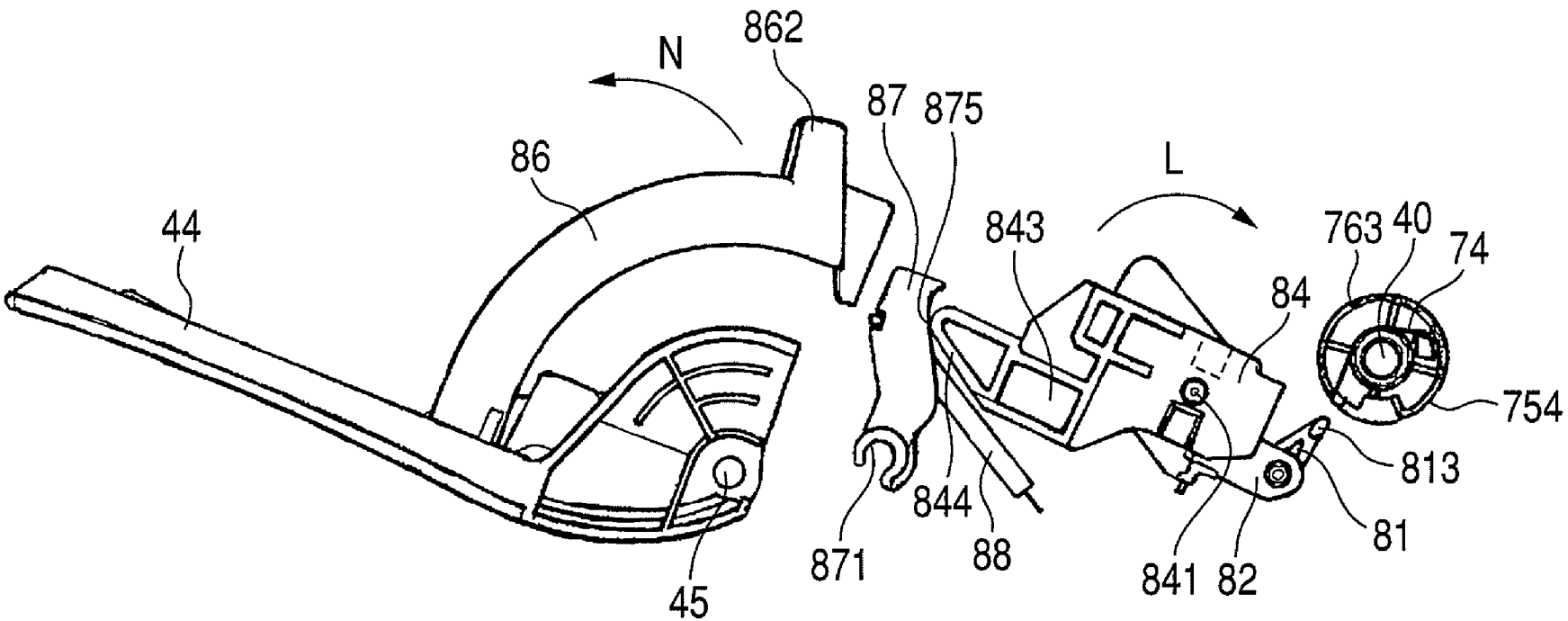
FIG. 7 is a side view of the opening/closing control section when the delivery tray is open.
Figure 8A:
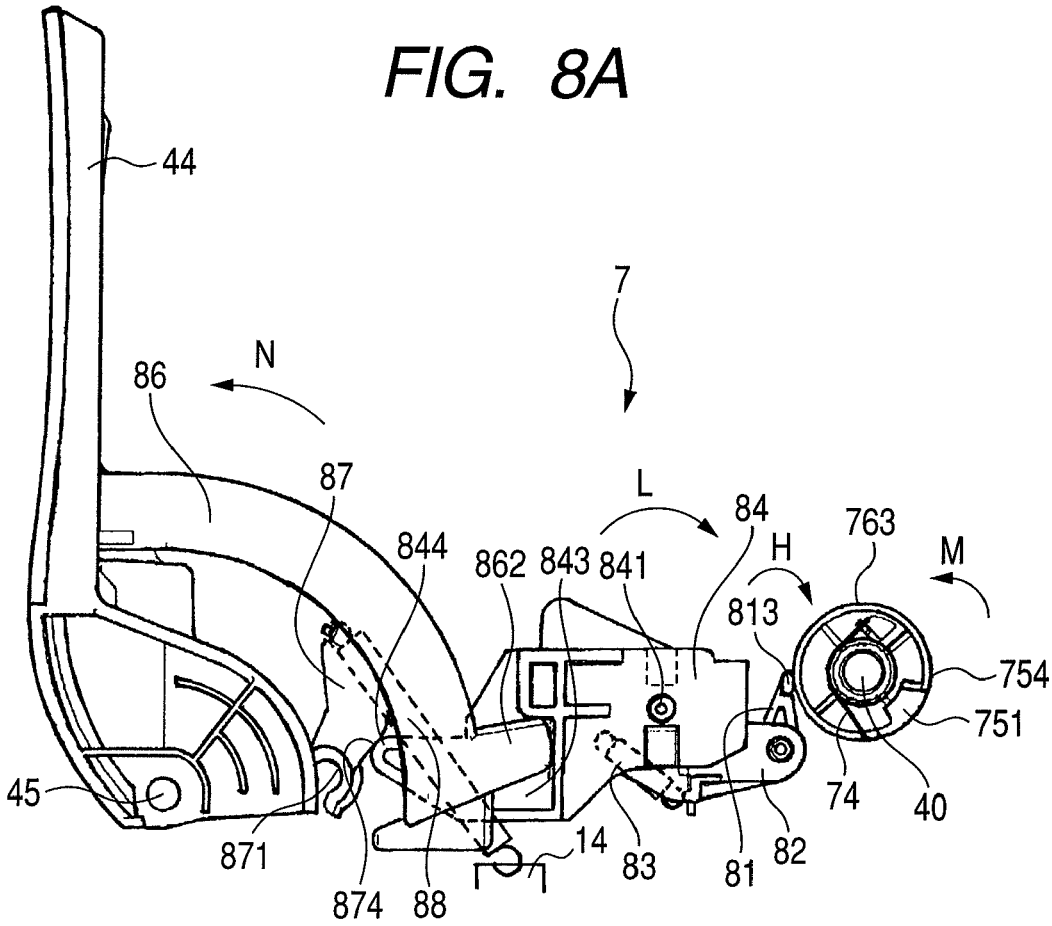
FIG. 8A is a side view of the opening/closing control section when the delivery tray is closed.
Figure 9:
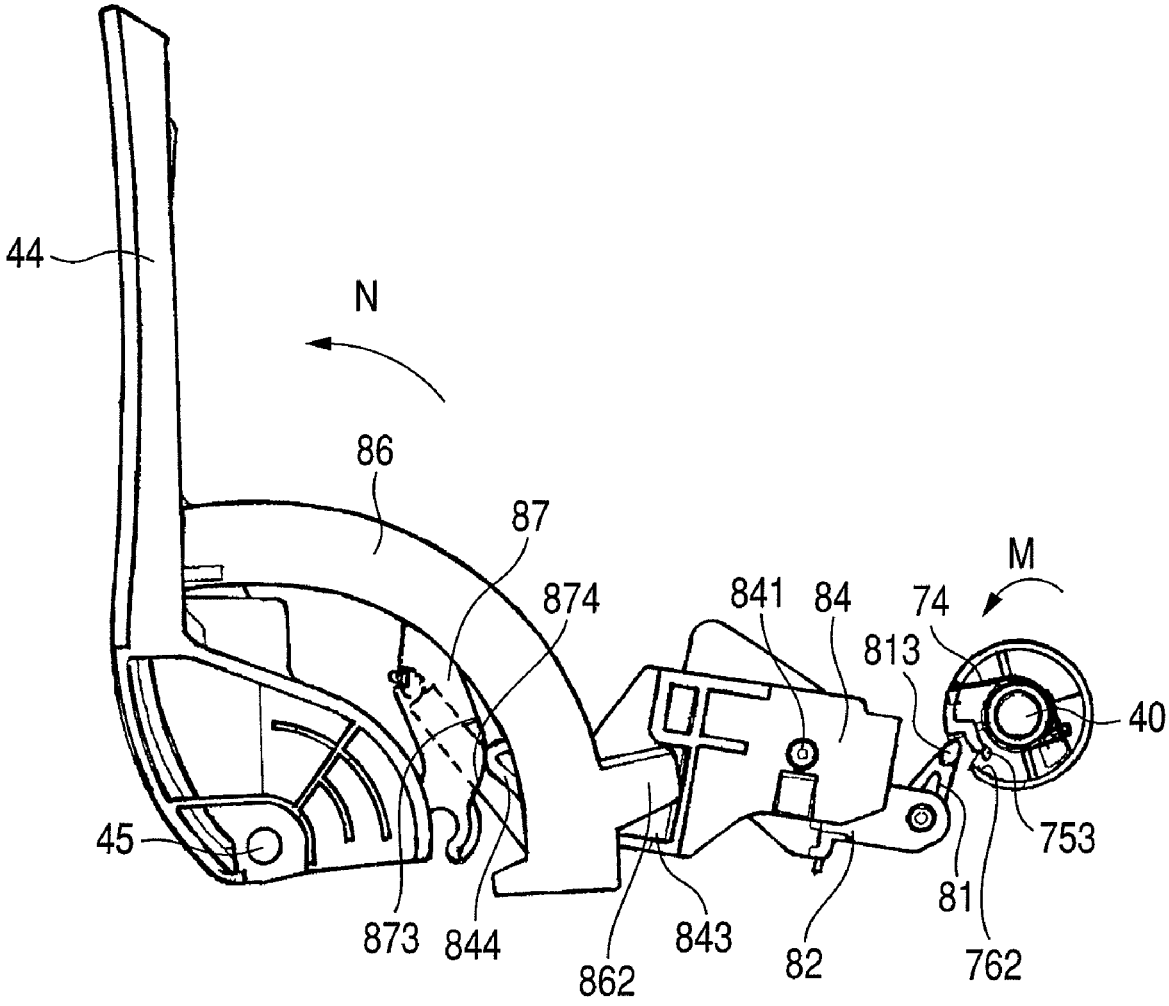
FIG. 9 is a side view of the opening/closing control section in the process of opening the delivery tray.

The opening/closing control section 7 for the delivery tray 44 is provided in the recording apparatus according to the embodiment. FIG. 3 is an exploded perspective view of the delivery tray opening/closing control section as seen from above the right front side. FIG. 5 is a perspective view of the delivery tray opening/closing control section as seen from above the left front side. FIG. 6 is a side view of the delivery tray opening/closing control section in the process of opening or closing. FIG. 7 is a side view of the opening/closing control section when the delivery tray is open. FIG. 8A is a side view of the opening/closing control section when the delivery tray is closed. FIG. 9 is a side view of the opening/closing control section in the process of opening the delivery tray.

The structure of the opening/closing control section 7 for the delivery tray 44 will first be described. A delay mechanism, which comprises plural ring members rotatable with some delay in sync with the rotation of the delivery roller 40, is provided around a shank of the delivery roller 40. A ring 71, a first delay ring 72, a second delay ring 73, a first trigger ring 75, and a second trigger ring 76 are inserted into the shank rotating in sync with the delivery roller 40 in this order from right to left in a manner to fit into the shank. A delay ring spring 74 is inserted between the second delay ring 73 and the first trigger ring 75.

The ring 71 is fastened around the delivery roller 40 with a parallel pin 77 in an engaging portion 711. One end portion 741 of the delay ring spring 74 is caught in the first trigger ring 75 in an engaged state, and the other end portion 742 is inserted into the first trigger ring 75 in the range of a notch portion 751 of the first trigger ring 75. The delay ring spring 74 is urged in the direction of arrow G in the notch portion 751 of the first trigger ring 75. Thus, the first trigger ring 75 can be urged in the direction of arrow G.

The opening/closing control section 7 for the delivery tray 44 includes a control mechanism as an opening/closing force transmitting unit comprising plural link members and plural elastic members. This control mechanism has an input link 81, an output link 84, a first link 86, a second link 87, an input link spring 83, an output link spring 85, and a second link spring 88. The input link 81 is rotatably supported by a shaft bearing portion 821 of an input link holder 82 through a rotating shaft 811 thereof. The input link spring 83 is suspended in a tensioned state between an engaging portion 812 of the input link 81 and an engaging portion (not illustrated) of the input link holder 82. Thus, the input link 81 is urged in the direction of arrow H.

A rotating shaft 822 of the input link holder 82 is rotatably supported by a shaft bearing portion 841 of the output link 84. The shaft bearing portion 841 of the output link 84 is pivotally supported by an unillustrated shank of the apparatus main body. The output link spring 85 is suspended in a tensioned state between an engaging portion 823 of the input link holder 82 and an engaging portion 842 (FIG. 5) of the output link 84. Thus, the input link holder 82 is urged in the direction of arrow J.

The first link 86 is connected (e.g., fastened) to the delivery tray 44 in one end portion 861 thereof. In other words, one link member (first link) 86 among the plural link members that construct the control mechanism is connected to the delivery tray 44. A projecting portion 862 as a first engaging portion is provided in the other end portion of the first link 86. This projecting portion 862 can be engaged with a depressed portion 843 of the output link 84 as a second engaging portion. The projecting portion 862 as the first engaging portion of the first link 86 is engaged with the depressed portion 843 as the second engaging portion in such a state that the delivery tray 44 is closed (FIG. 8A), and separated from the depressed portion 843 in such a state that the delivery tray 44 is open (FIG. 7). The second link 87 as a holding unit is rotatably supported by a shank 13 (FIG. 5) of the apparatus main body through a bearing portion 871 thereof.

The second link spring 88 is suspended in a tensioned state between an engaging portion 872 of the second link 87 and an engaging portion 14 (FIG. 5) of the apparatus main body. Thus, the second link 87 is urged in the direction of arrow K. A projecting portion 844 of the output link 84 is in contact with a cam surface 873 of the second link 87. The output link 84 is held in either a first position where the projecting portion 844 is in contact with a lower portion 874 of the cam surface 873 or a second position where the projecting portion 844 is in contact with an upper portion 875 of the cam surface 873 as a result of the rotation of the second link 87 in the direction of arrow K. The urging force of the second link spring 88 exerted on the output link 84 in the first position or second position of the second link 87 is set to about 50 g. When the output link 84 is held in the first position, the delivery tray 44 is closed (FIG. 8A), while when the output link 84 is held in the second position, the delivery tray 44 is open (FIG. 7).

The operation of the opening/closing control section 7 for the delivery tray 44, which has the above structure, will next be described. The conveyance motor as a drive source can be driven to rotate in the forward and reverse directions. When the sheet material P is conveyed for recording, the conveyance motor 32 is driven to rotate in the forward direction. First, an operation when the closed delivery tray 44 is automatically opened along with ejection of the sheet material P by means of the delivery roller 40 will be described.

(1) When the delivery roller 40 rotates in the direction of arrow M by the drive of the conveyance motor 32 to rotate in the forward direction, the ring 71 fixed integrally with the delivery roller 40 also rotates in the direction of arrow M. At this time, the first delay ring 72 does not rotate immediately in response to the rotation of the ring 71. After the ring 71 rotates to bring a projecting portion 712 thereof into contact with a projecting portion 721 of the first delay ring 72, the first delay ring 72 rotates with some delay in the direction of arrow M. In the embodiment, the first delay ring 72 is set to rotate when the delivery roller 40 rotates 320 degrees at the maximum. Here, 320 degrees at the maximum is set because the relative position between the ring 71 and the first delay ring 72 is indefinite when the delivery roller 40 begins rotating in the direction of arrow M.

(2) An engaging unit similar to that between the ring 71 and the first delay ring 72 is also provided between the first delay ring 72 and the second delay ring 73. The second delay ring 73 rotates with more delay in the direction of arrow M. In the embodiment, the second delay ring 73 is set to rotate when the delivery roller 40 rotates 300 degrees at the maximum.

Figure 4A:
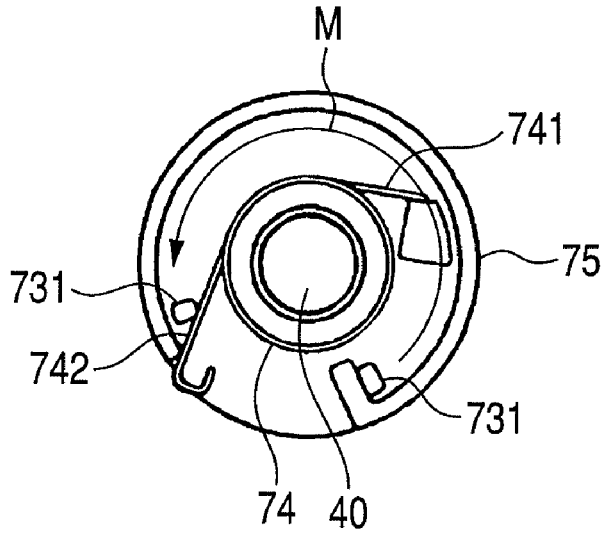
FIG. 4A is a detailed view of a delay mechanism.

(3) It is also set that a projecting portion 731 of the second delay ring 73 comes into contact with an end portion (the other end portion) 742 of the delay ring spring 74 as the elastic member when the delivery roller 40 further rotates 261.5 degrees at the maximum (FIG. 4A).

Figure 4B:
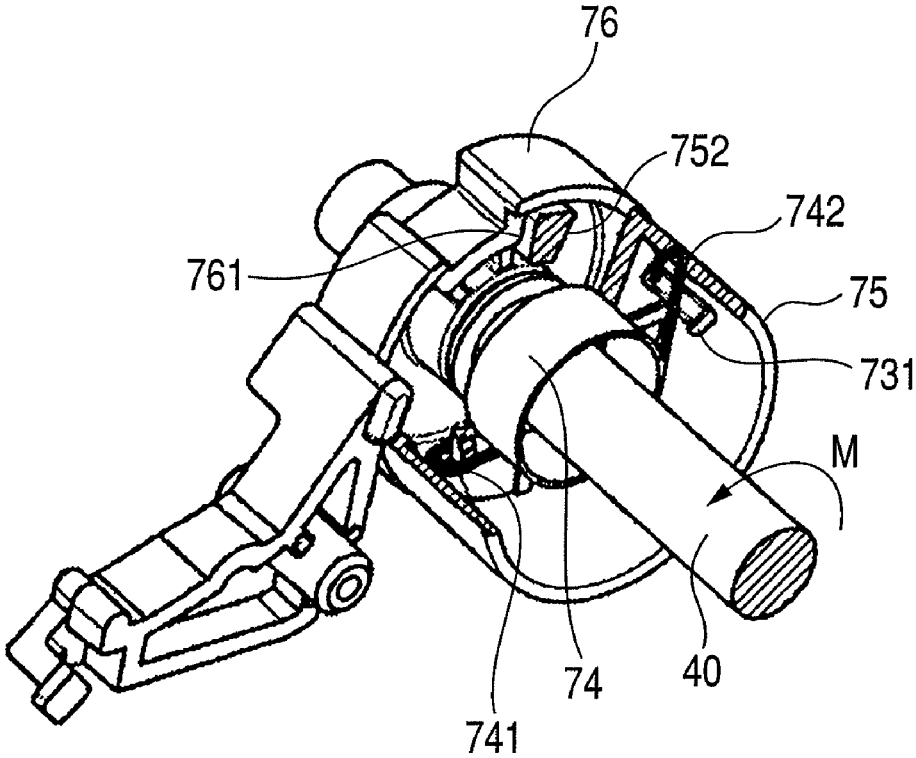
FIG. 4B is a detailed view of the delay mechanism.
Figure 8B:
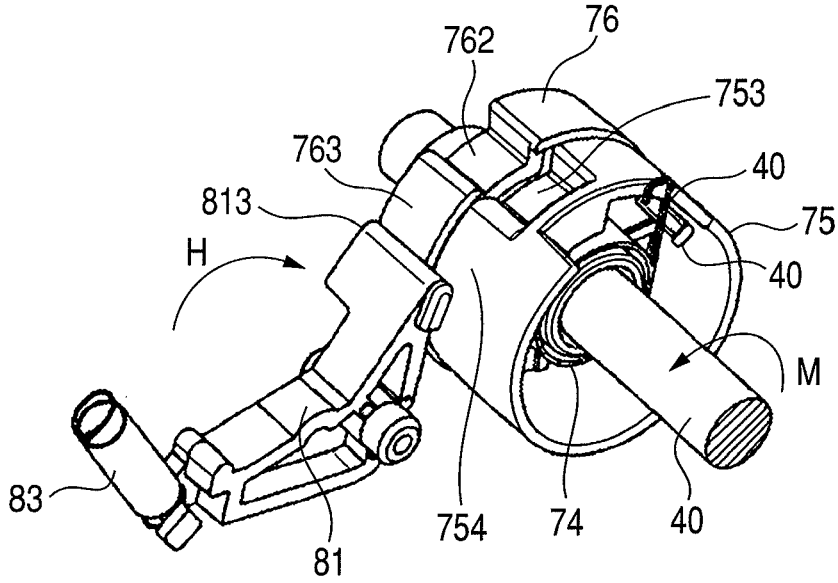
FIG. 8B is a detailed view of a trigger ring.

(4) When the delivery roller 40 further rotates in the direction of arrow M, the other end portion 742 of the delay ring spring 74 rotates. Therefore, the first trigger ring 75 as a first rotating body, which is caught with another end portion (one end portion) 741 of the delay ring spring 74, rotates in the direction of arrow M by the elastic force of the delay ring spring 74. When the delivery roller 40 further rotates 250 degrees at the maximum, a projecting portion 752 of the first trigger ring 75 comes into contact with a first receiving portion 761 of the second trigger ring 76 as a second rotating body (FIG. 4B). In this state, as illustrated in FIG. 8B, a depressed cam portion (first depressed portion) 753 of the first trigger ring 75 and a depressed cam portion (second depressed portion) 762 of the second trigger ring 76 are so provided that both phases match. In other words, the first trigger ring 75 and the second trigger ring 76 rotate in such a state that the first depressed portion 753 and the second depressed portion 762 are aligned in the axial direction of the delivery roller 40. Such an arrangement provides, in the delay mechanism, the plural cam portions 753 and 762 rotatable together with the plural ring members and a phase control unit for controlling the phases of the plural cam portions 753 and 762 in the direction of rotation.

(5) An outer peripheral surface 763 of the second trigger ring 76 is formed about 0.2 mm larger in diameter than an outer peripheral surface 754 of the first trigger ring 75. Further, the input link 81 is urged in the direction of arrow H by the elastic force of the input link spring 83 as the elastic member. Therefore, an input projecting portion 813 of the input link 81 comes into contact with the outer peripheral surface 763 of the second trigger ring 76 and becomes slidable.

Figure 10A:
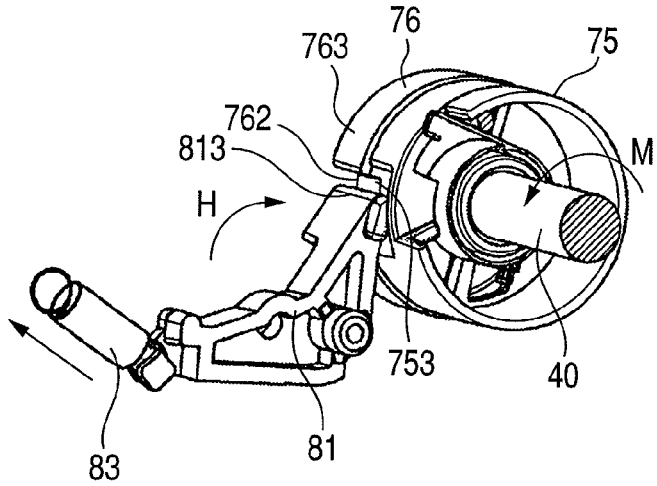
FIG. 10A is a view illustrating a trigger ring and an input link in the process of opening the delivery tray.

(6) When the delivery roller 40 further rotates in the direction of arrow M in such a state that the phases of the plural cam portions 753 and 762 match, the second trigger ring 76 begins rotating in the direction of arrow M. The input projecting portion 813 of the input link 81 is sliding on the outer peripheral surface 763 of the second trigger ring 76 (FIG. 8A and FIG. 8B). When the delivery roller 40 further rotates 330 degrees at the maximum, the input projecting portion 813 of the input link 81 is engaged, by the elastic force of the input link spring 83, with the depressed cam portion 753 and the depressed cam portion 762 whose phases in the direction of rotation match (FIG. 9 and FIG. 10A).

Figure 10B:
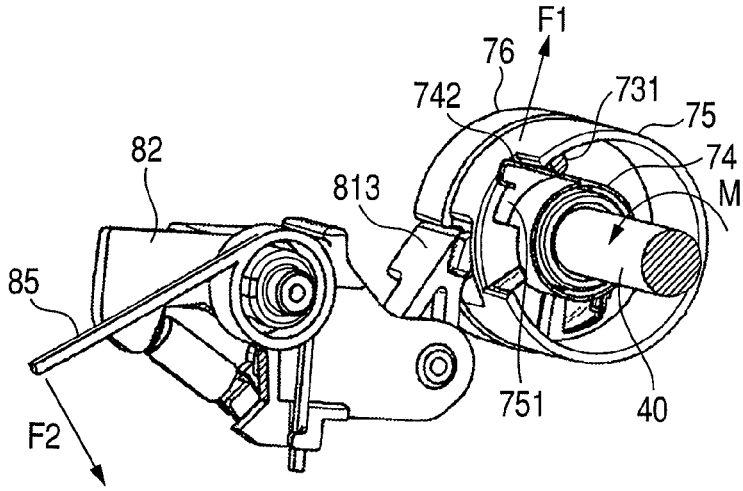
FIG. 10B is a view illustrating the trigger ring and the input link in the process of opening the delivery tray.

(7) Urging force F1 of the delay ring spring 74 is set to about 5 g. Urging force F2 of the output link spring 85 as the elastic member is set to about 100 g (FIG. 10B). Therefore, even if the delivery roller 40 further rotates in the direction of arrow M in such a state that the input projecting portion 813 is engaged with the cam portions 753 and 762 like (6) mentioned above, the first trigger ring 75 and the second trigger ring 76 do not rotate. Instead, the end portion (the other end portion) 742 of the delay ring spring 74 is bent in a direction opposite to arrow G (in the direction of arrow M) in the range of the notch portion 751 of the first trigger ring 75.

Figure 10C:
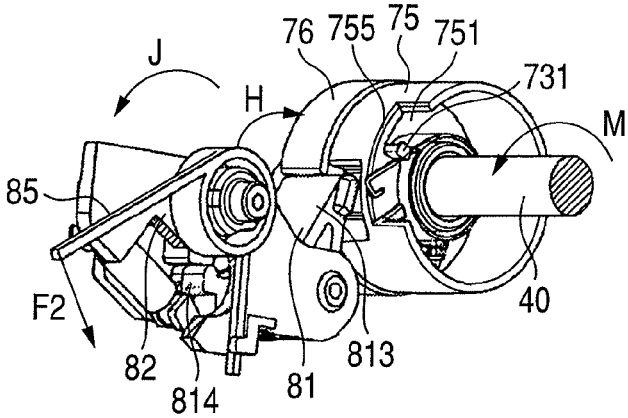
FIG. 10C is a view illustrating the trigger ring and the input link in the process of opening the delivery tray.

(8) When the delivery roller 40 further rotates 40 degrees, the delay ring spring 74 elastically deforms to bring the projecting portion 731 of the second delay ring 73 into contact with a contact surface 755 of the first trigger ring 75 (FIG. 10C). Therefore, a driving force is transmitted by the projecting portion 731 of the second delay ring 73 and the contact surface 755 of the first trigger ring 75 without going through the delay ring spring 74. Then, the first trigger ring 75 and the second trigger ring 76 rotate in the direction of arrow M.

(9) A rotation stop portion 814 of the input link 81 is in contact with the input link holder 82 in such a state that the input projecting portion 813 of the input link 81 is engaged with the depressed cam portion 753 of the first trigger ring 75 and the depressed cam portion 762 of the second trigger ring 76 whose phases match each other. For this reason, the rotational power of the input link 81 in the direction of arrow H turns into an actuating force to rotate the input link holder 82 in a direction opposite to arrow J. Here, when the delivery roller 40 further rotates in the direction of arrow M, the rotational actuating force overcomes the urging force F2 of the output link spring 85 to rotate input link holder 82 in the direction opposite to arrow J.

Figure 11A:
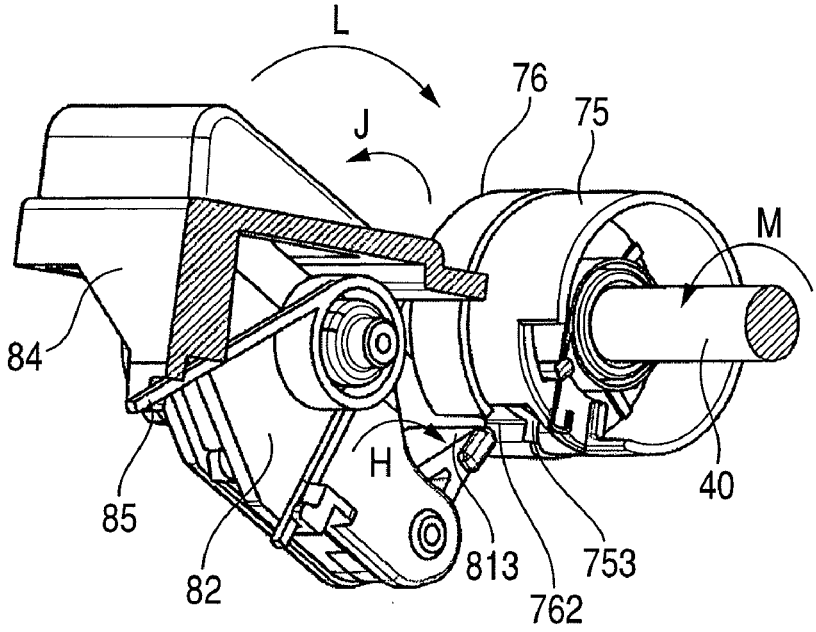
FIG. 11A is a view illustrating an output link when the delivery tray is opened.
Figure 11B:
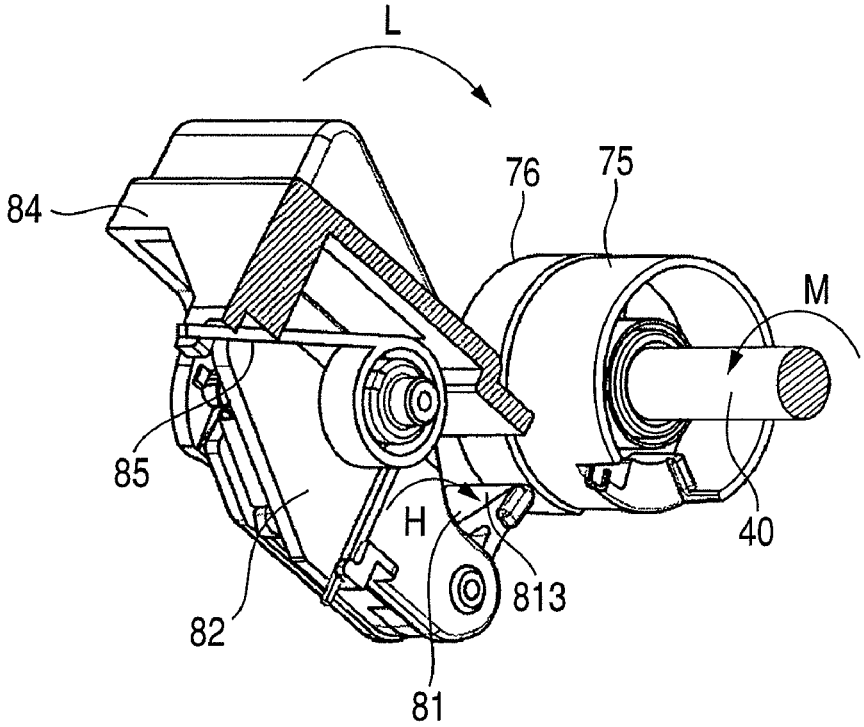
FIG. 11B is a view illustrating the output link when the delivery tray is opened.

(10) When the input link holder 82 rotates in the direction opposite to arrow J, the output link 84 rotates in the direction of arrow L from the first position (FIG. 8A and FIG. 9) to the second position (FIG. 6 and FIG. 7) by a reaction force of the output link spring 85. In other words, the driving force of the delivery roller 40 is transmitted to the output link 84 through the first trigger ring 75 and the second trigger ring 76 to rotate the output link 84 in the direction of arrow L against the holding force of the second link 87 urged by the second link spring 88 (FIG. 11A). When the output link 84 reaches the second position, the output link 84 is held in the second position by means of the second link 87 and the second link spring 88 as the elastic member as mentioned above. In this second position, the input projecting portion 813 of the input link 81 is released from the engaged state with (separated from) the depressed cam portion 753 of the first trigger ring 75 and the depressed cam portion 762 of the second trigger ring 76 whose phases match each other. Therefore, the first trigger ring 75 and the second trigger ring 76 rotate in a direction opposite to arrow G with respect to the second delay ring 73 by the elastic force of the delay ring spring 74 (FIG. 11B).

(11) When the output link 84 rotates in the direction of arrow L and reaches the second position (FIG. 6), the projecting portion 862 of the end portion (the other end portion) of the first link 86 engaged with the depressed portion 843 of the output link 84 rotates in the direction of arrow N, and the first link 86 rotates in the direction of arrow N. Here, since the first link 86 is fastened to the delivery tray 44, the delivery tray 44 also rotates about the rotating shaft 45 in the direction of arrow N. At this time, the projecting portion 862 at the other end of the first link 86 is released from the engaged state with the depressed portion 843 of the output link 84 (FIG. 6 to FIG. 7). Further, since the vertical position of the center of gravity of the delivery tray 44 is located more outside the apparatus (the left side in FIG. 6) than the position of the rotating shaft 45, the delivery tray 44 rotates about the rotating shaft 45 under self-weight in the direction of arrow N (in the direction to open). Thus, the delivery tray 44 rotates to an open-position contact portion of the apparatus main body and becomes a state where the delivery tray 44 is held, i.e., open (FIG. 7). The sheet material P after subjected to recording by the recording section 5 is conveyed by the conveyance roller 31, ejected by the delivery roller 40 onto the delivery tray 44 in the open state, and placed and held on the delivery tray 44.

As described above, in the embodiment, the driving force of the delivery roller is transmitted to the control mechanism comprising the plural link members 81, 84, 86, and 87, and the plural elastic members 83, 85, and 88 when the phases of the plural cam portions 753 and 762 of the delay mechanism in the direction or rotation match. Then, through this control mechanism, the delivery tray 44 in the closed state is automatically shifted to the open state. In other words, in the embodiment, the delivery roller 40 rotates about 150.5 degrees at the maximum (maximum delayed operating angle) in the direction of arrow M during the operations from (1) to (11) mentioned above, bringing the delivery tray 44 to the open state as illustrated in FIG. 7. According to the embodiment, the delivery tray 44 is automatically shifted to the open state when the sheet material P is conveyed without the need for a solenoid or the like to open the delivery tray 44.

On the other hand, the recording head 51 of the recording apparatus according to the embodiment is the inkjet recording head that discharges ink from the discharge ports onto the sheet material P to perform recording. In a predetermined position outside a recording area in a moving range of the carriage 50 inside the recording apparatus, the recovery section 6 for performing maintenance and recovery of ink discharge performance of the recording head 51 is provided. There, the suction pump 60 in the recovery section 6 is driven by the drive of the conveyance motor 32 in the forward and reverse directions of rotation. The suction pump 60 is driven in such a manner that, after the conveyance motor 32 is rotated by a predetermined amount in the reverse direction to secure the maximum delayed operating angle of the opening/closing control section 7 for the delivery tray 44 (150.5 degrees at the maximum), the conveyance motor 32 is rotated in the forward direction within the maximum delayed operating angle. In other words, the driving of the suction pump 60 by the conveyance motor 32 is terminated before the input projecting portion 813 of the input link 81 is engaged with the depressed cam portion 753 of the first trigger ring 75 and the depressed cam portion 762 of the second trigger ring 76 whose phases match each other. It is preferable to terminate the driving of the suction pump 60 before the start of transmission of the driving force from the delay ring spring 74 to the first trigger ring 75. To this end, the conveyance motor 32 is driven to rotate by the predetermined amount in the reverse direction before the driving of the suction pump 60 in order to make the most of the delay time through the plural delay rings.

In other words, in the embodiment, the recovery section 6 for maintenance and recovery of ink discharge performance of the recording head 51 is driven by the same source as the delivery roller. Further, the delivery tray 44 in the closed state is prevented from opening inadvertently against operator's intention during operations other than the recording operation such as the recovery action. Here, the operations other than the recording operation may include operations for initialization and termination after recording.

Next, an operation when the delivery tray 44 in the open state is closed will be described. After the sheet material(s) is removed from the delivery tray 44 in such a state that the delivery tray 44 is open (FIG. 7), the operator holds the upper end portion of the delivery tray 44 and pivots the delivery tray 44 about the rotating shaft 45 in the direction opposite to arrow N. Then, when the delivery tray comes to a position on the way to the end of the opening/closing operation as illustrated in FIG. 6, the projecting portion 862 of the first link 86 fastened integrally with the delivery tray 44 comes into the depressed portion 843 of the output link 84. When the delivery tray is further pivoted in the direction opposite to arrow N, the output link 84 is rotated by the projecting portion 862 of the first link 86 in the direction opposite to arrow L about the shaft bearing portion 841, reaching the first position as illustrated in FIG. 8A. The output link 84 is held in the first position by the second link 87 and the urging force of the second link spring 88 as mentioned above. The urging force of the second link spring 88 is set to about 50 g to prevent rotation in the direction of arrow N (movement in the direction to open) under the self-weight of the delivery tray 44. Thus, the delivery tray 44 is held in the closed state through the first link 86. In other words, when the delivery tray 44 is rotated to shift from the open state to the closed state, the delivery tray 44 is held in the closed state by the link members and the elastic members of the control mechanism.

Figure 12A:
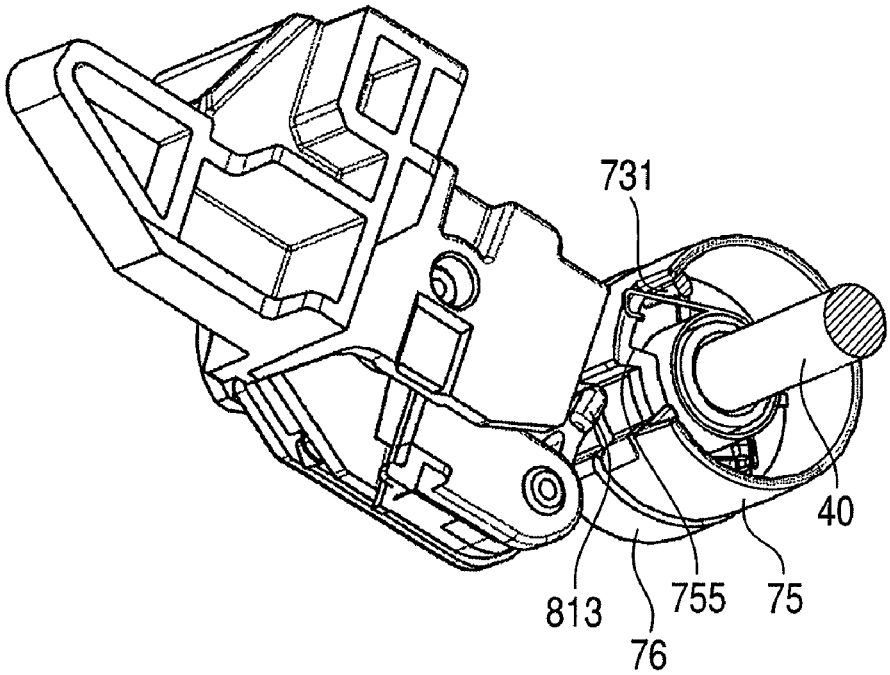
FIG. 12A is a view illustrating the trigger ring and the input link when the delivery tray is closed.

When the delivery tray 44 shifts from the open position in FIG. 7 to the position on the way to the end of the opening/closing operation in FIG. 6 and to the closed position in FIG. 8A, the tip end portion (input projecting portion) 813 of the input link 81 comes into contact with either the outer peripheral surface 754 of the first trigger ring 75 or the outer peripheral surface 763 of the second trigger ring 76. However, this causes no obstacle because the input link 81 rotates in the direction opposite to arrow H against the elastic force of the input link spring 83 as illustrated in FIG. 8A. As illustrated in FIG. 9, since the relative position between the first trigger ring 75 and the second trigger ring 76 is indefinite, there may be a case where the phases of the depressed cam portions 753 and 762 match by chance. There may also be a case where the depressed cam portions 753 and 762 whose phases match are located in the working range of the tip end portion (input projecting portion) 813 of the input link 81 (FIG. 12A).

Next, an operation in this state will be described. In this state, the tip end portion 813 of the input link 81 comes into the depressed portion 753 of the first trigger ring 75 and the depressed portion 762 of the second trigger ring 76 whose phases match each other. If the conveyance motor 32 is stopped, it is difficult to have the input link 81 rotate the delivery roller 40 in the direction opposite to arrow M, owing to the holding torque during stopping the conveyance motor, the reduction gear ratio of the delivery roller 40, or the like. However, as described with reference to FIG. 3, the first trigger ring 75 and the second trigger ring 76 can rotate within the actuating range of the delay ring spring 74, i.e., 40 degrees, with respect to the second delay ring 73. The urging force F1 of this delay ring spring 74 is about 5 g as mentioned above. Therefore, the delivery tray 44 can be closed in the direction opposite to arrow N to rotate the first trigger ring 75 and the second trigger ring 76 in the direction opposite to arrow M through the input link 81 as illustrated in FIG. 9, bringing the delivery tray 44 to the closed state as illustrated in FIG. 8A. Such a structure and operation enables manual closing of the delivery tray 44.

Figure 12B:
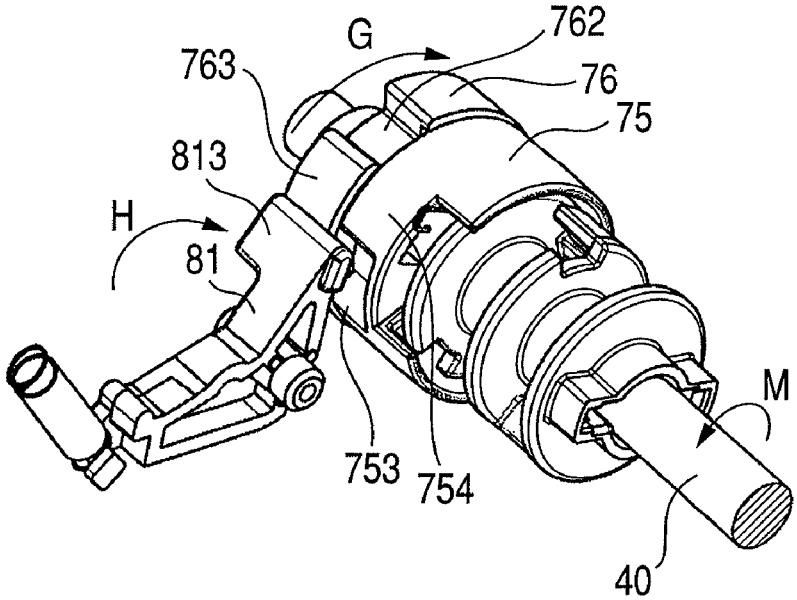
FIG. 12B is a view when a conveyance motor is driven in such a state that the delivery tray is closed.
Figure 13:
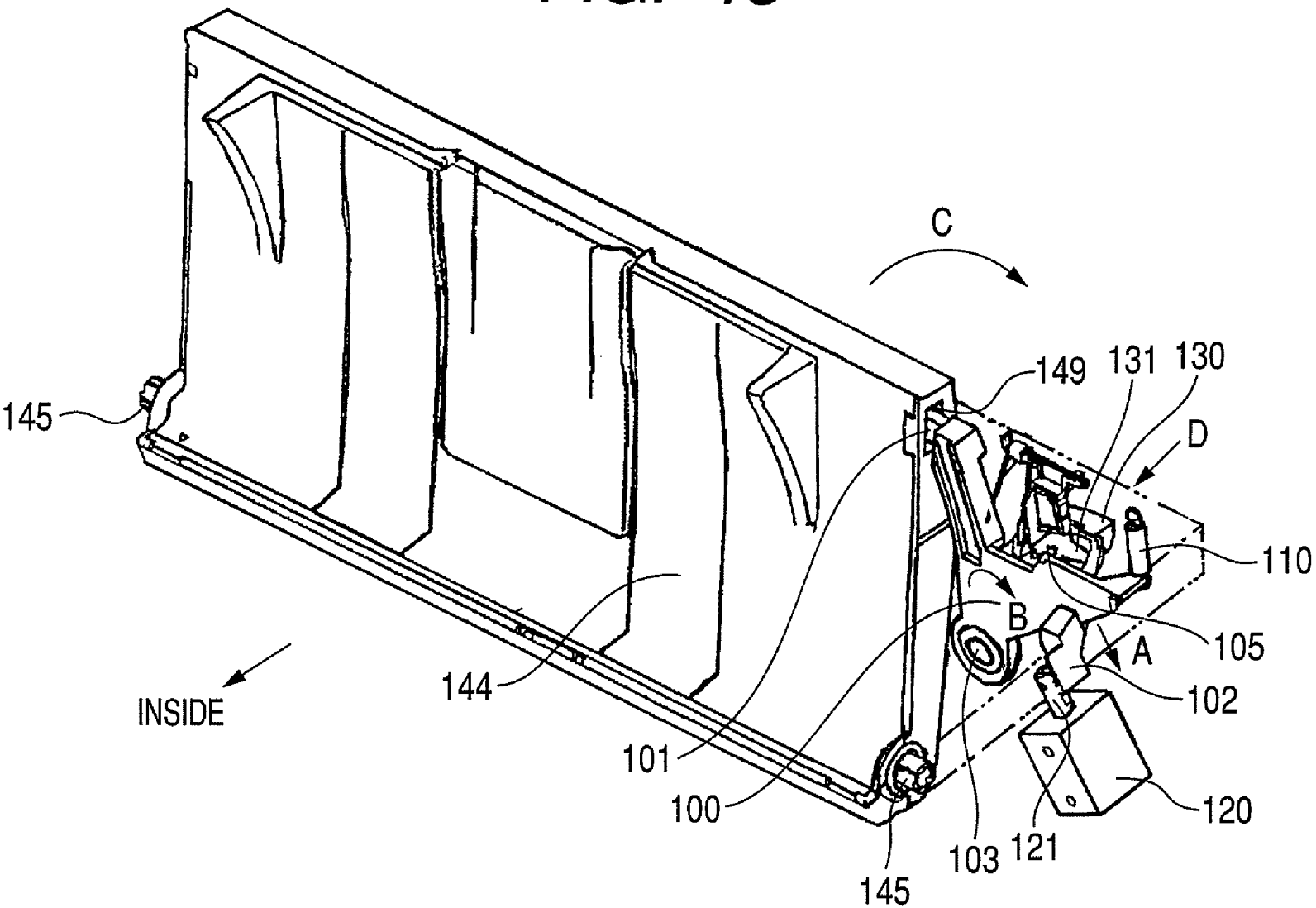
FIG. 13 is a perspective view of an automatic opening mechanism of a conventional delivery tray.

In the embodiment, as mentioned above, the feeder section 2, the conveyance section 3, the recovery section 6, and the delivery section 4 are driven by the drive of the conveyance motor 32. Next, a case where the conveyance motor 32 reversely rotates in such a state that the delivery tray 44 is closed will be described. When the delivery roller 40 rotates by a predetermined amount in the direction opposite to arrow M by the drive of the conveyance motor 32 to rotate reversely, the first trigger ring 75 rotates in the direction of arrow G and thus the projecting portion 752 of the first trigger ring 75 comes into contact with the second receiving portion 764 of the second trigger ring 76. In the embodiment, the depressed cam portion 753 of the first trigger ring 75 and the depressed cam portion 762 of the second trigger ring 76 are so set that the relative positions (phases) thereof in the direction of rotation do not match in this state (FIG. 12B).

Therefore, when the delivery tray 44 is in the closed state as illustrated in FIG. 8A, the tip end portion (input projecting portion) 813 of the input link 81 slides in such a state that the tip end portion 813 is urged in contact with the outer peripheral surface 754 of the first trigger ring 75 or the outer peripheral surface 763 of the second trigger ring 76. Therefore, the tip end portion 813 of the input link 81 is prevented from being engaged with the depressed cam portion 762 of the second trigger ring 76 or the depressed cam portion 753 of the first trigger ring 75. Thus, the second receiving portion 764 serves as a blocking unit. Further, it can be eliminated that the tip end portion 813 of the input link 81 collides with the outer peripheral surface 763 of the second trigger ring 76 to produce an operating sound of the input link 81. This can eliminate the occurrence of unintended (or unpleasant) abnormal noise caused by the drive of the conveyance motor 32 to rotate reversely. For example, the feed roller 22 as a feed unit performs the feeding operation by the drive of the conveyance motor 32 to rotate reversely, and in that case, the occurrence of abnormal noise can be prevented.

Next, an operation when the operator manually opens the delivery tray 44 in the closed state will be described. The operator holds the upper end portion of the delivery tray 44 and rotates the delivery tray 44 about the rotating shaft 45 in the direction of arrow N. As a result, as illustrated in FIG. 8A, the output link 84 is rotated in the direction of arrow L by the projecting portion 862 at the other end of the first link 86 fastened integrally with the delivery tray 44. Here, the magnitude of an operating force to rotate the output link 84 from the first position to the second position against the elastic force of the second link spring 88 is set to about 200 g at the upper end of the delivery tray 44. When the projecting portion 862 of the first link 86 is disengaged from the depressed portion 843 of the output link 84, the delivery tray 44 becomes the open state as illustrated in FIG. 7, and is held in the open position. In other words, when the delivery tray 44 is rotated to open, the delivery tray 44 is held in the open state by disengaging the plural link members of the control mechanism from one another.

The recording apparatus according to the embodiment described above includes the recording head 51 for recording an image on the sheet material P, the delivery roller 40 for ejecting the sheet material after subjected to recording, and the delivery tray 44 foldably attached to hold the sheet material ejected by the delivery roller 40. The recording apparatus also includes the delay mechanism comprising the plural ring members 71, 72, 73, 75, and 76 rotatable with some delay in sync with the conveyance unit, and the control mechanism as the opening/closing force transmitting unit comprising the plural link members 81, 84, 86, and 87, and the plural elastic members 83, 85, and 88. The plural cam portions 753 and 762 rotatable together with the plural ring members and the phase control unit for controlling the phases of the plural cam portions 753 and 762 in the direction of rotation are provided in the delay mechanism. This phase control unit comprises the delay ring spring 74, the projecting portion 752 of the first trigger ring 75, and the first receiving portion 761 of the second trigger ring 76. When one link member 86 of the control mechanism is connected to the delivery tray and the phases of the plural cam portions 753 and 762 match, the delivery tray 44 is opened by the drive of the delivery roller 40 (by the drive of the conveyance motor 32) through the control mechanism.

Although the aforementioned embodiment illustrates a case where the opening/closing control section 7 for the delivery tray 44 is provided around the delivery roller 40, the present invention is also applicable to a case where the opening/closing control section 7 is provided around the conveyance roller 31. Further, although the recording apparatus of the serial type that forms an image by reciprocating the recording head 51 is described, the present invention is applicable as well to a recording apparatus of the line type that forms an image line by line collectively with paper feed only.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-140599, filed May 29, 2008, which is hereby incorporated by reference herein its entirety.

What is claimed is:

1. A recording apparatus comprising:

a delivery roller for ejecting a sheet material;

a delivery tray openably/closably attached to an apparatus main body to hold the sheet material ejected by the delivery roller;

a delay mechanism comprising plural ring members rotatable with some delay in sync with the delivery roller;

a control mechanism comprising plural link members and plural elastic members;

plural cam portions rotatable together with the plural ring members; and a phase control unit for controlling phases of the plural cam portions, wherein one link member of the control mechanism is connected to the delivery tray, and the delivery tray is opened through the control mechanism by a drive of the delivery roller when the phases of the plural cam portions match.

2. The recording apparatus according to claim 1, wherein when the delivery tray is rotated to a closed state, the delivery tray is held in the closed state by the link members and the elastic members of the control mechanism.

3. The recording apparatus according to claim 1, wherein when the delivery tray is rotated to an open state, the plural link members of the control mechanism are disengaged from one another to hold the delivery tray in the open state.

4. The recording apparatus according to claim 1, wherein a conveyance roller arranged on an upstream side of a recording head in a conveyance direction of the sheet material to convey the sheet material is provided, and the conveyance roller is driven by a drive source for driving the delivery roller.

5. The recording apparatus according to claim 1, wherein an elastic member is provided in the phase control unit.

6. The recording apparatus according to claim 1, wherein the recording head is an inkjet recording head for discharging ink from discharge ports onto a recording medium to perform recording.

7. The recording apparatus according to claim 6, further comprising:

a recovery section for performing maintenance and recovery of ink discharge performance of the recording head, wherein the recovery section is driven by a drive source for driving the delivery roller.

8. A sheet ejection device comprising:

an ejection roller for ejecting a sheet;

a drive source for driving the ejection roller;

a tray openably/closably attached to an apparatus main body to hold the sheet ejected by the ejection roller;

a first engaging portion, which rotates in sync with the tray;

a second engaging portion, which is engaged with the first engaging portion in a first position to hold the tray in a closed state, and which moves from the first position to a second position to release the first engaging portion;

a holding unit for holding the second engaging portion in the first position;

a transportation unit for moving the second engaging portion by a driving force of the drive source from the first position to the second position against holding power of the holding unit; and a transmission unit for transmitting the driving force of the drive source to the transportation unit.

9. The sheet ejection device according to claim 8, wherein the transportation unit has a rotatable link member for supporting the second engaging portion and a projection provided in the link member, and moves the engaging portion from the first position to the second position along with rotation of the link member, and the transmission unit has a first rotating body with a first depressed portion to be engaged with the projection, and the first rotating body rotates by the driving force of the drive source to rotate the link member in such a state that the depressed portion is engaged with the projection.

10. The sheet ejection device according to claim 9, wherein the first rotating body is rotatably supported by a shaft rotating by the drive force of the drive source in sync with the ejection roller, and the transmission unit has a blocking unit for preventing the projection from being engaged with the first depressed portion when the ejection roller rotates in a direction opposite to a direction to eject the sheet.

11. The sheet ejection device according to claim 10, wherein the blocking unit has a second rotating body rotatably supported by the shaft, and prevents the projection from being engaged with the first depressed portion, by causing the projection to come into contact with a circumferential surface of the second rotating body.

12. The sheet ejection device according to claim 11, wherein the second rotating body has a second depressed portion, and the first rotating body and the second rotating body have a phase control unit, and wherein the phase control unit controls phases in such a manner to align, in an axial direction, the first depressed portion and the second depressed portion of the first rotating body and the second rotating body, which have received transmission of a driving force from the drive source when the ejection roller rotates in a direction to eject the sheet, and when the first depressed portion and the second depressed portion rotate in such a state that the first depressed portion and the second depressed portion are aligned in the axial direction by means of the phase control unit, the projection is engaged with the first depressed portion to rotate the link member.

13. The sheet ejection device according to claim 12, wherein the phase control unit has a projecting portion provided in the first rotating body and a first receiving portion provided in the second rotating body, and the projecting portion of the first rotating body that rotates by receiving a driving force from the shaft when the ejection roller rotates in a direction to eject the sheet comes into contact with the first receiving portion to control the phases in such a manner that the first depressed portion and the second depressed portion aligns in the axial direction.

14. The sheet ejection device according to claim 12, wherein the phase control unit has a second receiving portion provided in the second rotating body, and the projecting portion of the first rotating body that rotates by receiving a driving force from the shaft when the ejection roller rotates in a direction opposite to the direction to eject the sheet comes into contact with the second receiving portion to control the phases in such a manner that the first depressed portion and the second depressed portion does not align in the axial direction.

15. The sheet ejection device according to claim 14, wherein the transmission unit has plural ring members rotatable with some delay in sync with the ejection roller, and the first rotating body receives transmission of a driving force from the drive source through the plural ring members.

16. The sheet ejection device according to claim 14, wherein when the link member is not rotated, the transmission unit transmits the driving force through the elastic member, while when the link member is rotated, the elastic member elastically deforms and the transmission unit transmits the driving force without going through the elastic member.

17. The sheet ejection device according to claim 8, wherein when the tray is closed from the open state, if the projection is engaged with the first depressed portion and the second depressed portion along with the rotation of the link member, the elastic member elastically deforms and the first rotating body and the second rotating body rotate along with the rotation of the link member.

18. A recording apparatus comprising:

a feed unit for feeding a sheet;

a recording unit using a recording head to perform recording on the sheet fed by the feed unit; and the sheet ejection device according to claim 14, which ejects the sheet after subjected to recording by the recording unit, wherein the feed unit feeds the sheet by the driving force of the drive source when the ejection roller rotates in the direction opposite to the direction to eject the sheet.

19. A recording apparatus comprising:

a feed unit for feeding a sheet;

a recording unit using a recording head to perform recording on the sheet fed by the feed unit;

the sheet ejection device according to claim 15, which ejects the sheet after subjected to recording by the recording unit; and a pump for sucking ink from discharge ports of the recording head to recover the recording head, wherein the pump is driven by the driving force of the drive source and ends an operation thereof before the plural ring members begins transmission of the driving force to the first rotating body.

* * * * *